US006277009B1

(12) United States Patent
Chen et al.

(10) Patent No.: US 6,277,009 B1
(45) Date of Patent: Aug. 21, 2001

(54) CARRIER HEAD INCLUDING A FLEXIBLE MEMBRANE AND A COMPLIANT BACKING MEMBER FOR A CHEMICAL MECHANICAL POLISHING APPARATUS

(75) Inventors: Hung Chen, San Jose; Steven M. Zuniga, Soquel, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/478,943

(22) Filed: Jan. 6, 2000

Related U.S. Application Data

(63) Continuation of application No. 09/001,702, filed on Dec. 31, 1997, now Pat. No. 6,080,050.

(51) Int. Cl.[7] ..... B24B 7/22
(52) U.S. Cl. ..... 451/288; 451/388
(58) Field of Search ..... 451/288, 287, 451/388, 398, 41

(56) References Cited

U.S. PATENT DOCUMENTS

| | | | | |
|---|---|---|---|---|
| 4,193,226 | | 3/1980 | Gill, Jr. et al. . | |
| 4,373,991 | | 2/1983 | Banks . | |
| 4,892,455 | | 1/1990 | Hine . | |
| 4,897,966 | * | 2/1990 | Takahashi | 451/287 |
| 4,900,212 | | 2/1990 | Mikahara . | |
| 4,918,869 | * | 4/1990 | Kitta | 451/288 |
| 5,081,795 | | 1/1992 | Tanaka et al. . | |
| 5,180,273 | | 1/1993 | Sakaya et al. . | |
| 5,193,316 | | 3/1993 | Olmstead . | |
| 5,205,082 | | 4/1993 | Shendon et al. . | |
| 5,230,184 | | 7/1993 | Bukhman . | |
| 5,409,348 | | 4/1995 | Suzuki . | |
| 5,423,558 | | 6/1995 | Koeth et al. . | |
| 5,423,716 | * | 6/1995 | Strasbaugh | 451/288 |
| 5,441,444 | | 8/1995 | Nakajima . | |
| 5,443,416 | | 8/1995 | Volodarsky et al. . | |
| 5,449,314 | | 9/1995 | Meikle et al. . | |
| 5,449,316 | | 9/1995 | Strasbaugh . | |
| 5,476,414 | | 12/1995 | Hirose et al. . | |
| 5,498,199 | | 3/1996 | Karlsrud et al. . | |
| 5,547,415 | | 8/1996 | Hasegawa et al. . | |
| 5,584,751 | | 12/1996 | Kobayashi et al. . | |
| 5,624,299 | | 4/1997 | Shendon . | |
| 5,643,053 | | 7/1997 | Shendon . | |
| 5,820,448 | | 10/1998 | Shamouilian et al. . | |
| 5,851,140 | * | 12/1998 | Barns et al. | 451/288 |
| 6,056,632 | * | 5/2000 | Mitchel et al. | 451/289 |

FOREIGN PATENT DOCUMENTS

| | | |
|---|---|---|
| 8631087 | 4/1987 | (DE) . |
| 0 004 033 B1 | 9/1979 | (EP) . |
| 0 129 732 A1 | 1/1985 | (EP) . |
| 0 139 824 A2 | 5/1985 | (EP) . |
| 0 147 094 A2 | 7/1985 | (EP) . |
| 0156746 A1 | 10/1985 | (EP) . |
| 0 264 572 A1 | 4/1988 | (EP) . |
| 0 298 564 A1 | 1/1989 | (EP) . |

(List continued on next page.)

OTHER PUBLICATIONS

A. Mack, "Wafer Carrier," IBM Technical Disclosure Bulletin, vol. 16, No. 9, Feb. 1974, 4 pgs.

Larson et al., "Electrostatic Cleaning and Polishing of Substrates," IBM Technical Disclosure Bulletin, vol. 26, No. 1, Jun. 1983, pp. 399–400.

(List continued on next page.)

*Primary Examiner*—Robert A. Rose
(74) *Attorney, Agent, or Firm*—Fish & Richardson

(57) ABSTRACT

A carrier head for a chemical mechanical polishing apparatus includes a flexible membrane, the lower surface of which provides a substrate-receiving surface. The carrier head includes a compliant backing member with a plurality of cells which contact an upper surface of the flexible membrane to improve vacuum-chucking of the substrate.

12 Claims, 9 Drawing Sheets

FOREIGN PATENT DOCUMENTS

| | | |
|---|---|---|
| 0 378 805 B1 | 7/1990 | (EP) . |
| 0 433 503 A1 | 6/1991 | (EP) . |
| 0 456 884 A2 | 11/1991 | (EP) . |
| 0 473 954 A1 | 3/1992 | (EP) . |
| 0 578 351 A1 | 1/1993 | (EP) . |
| 0 539 896 A1 | 5/1993 | (EP) . |
| 0 595 071 A1 | 5/1994 | (EP) . |
| 0 650 806 A1 | 5/1995 | (EP) . |
| 0653270 A1 | 5/1995 | (EP) . |
| 0 660 377 A1 | 6/1995 | (EP) . |
| 0 847 835 A1 | 6/1998 | (EP) . |
| 61-25768 | 2/1986 | (JP) . |
| 63-114870 | 5/1988 | (JP) . |
| 63-300858 | 12/1988 | (JP) . |
| 64-2857 | 1/1989 | (JP) . |
| 1-155640 | 6/1989 | (JP) . |
| 1-216768 | 8/1989 | (JP) . |
| 1-303733 | 12/1989 | (JP) . |
| 2-243263 | 9/1990 | (JP) . |
| 62-124844 | 6/1991 | (JP) . |
| 4-171170 | 6/1992 | (JP) . |
| WO 94/191153 | 9/1994 | (WO) . |
| WO 96/36459 | 11/1996 | (WO) . |

OTHER PUBLICATIONS

Holley et al., "Mounting Method for Single–Side Polishing," IBM Technical Disclosure Bulletin, vol. 21, No. 10, Mar. 1979, 3 pgs.

Brun et al., "Process for Maintaining Wafer on Carrier During Single Side Polishing," IBM Technical Disclosure Bulletin, vol. 22, No. 6, Nov. 1979, 4 pgs.

Miklos, "Hand–Held Wafer–Handling Tool," IBM Technical Disclosure Bulletin, vol. 26, No. 8, Jan. 1984, 4 pgs.

Craft, "Modular Grind/Polish System," IBM Technical Disclosure Bulletin, vol. 26, No. 11, Apr. 1984, 2 pgs.

Pye et al., "High–density plasma CVD and CMP for 0.25–$\mu$m intermetal dielectric processing," Solid State Technology, 12/95, 5 pgs.

Sivaram et al., "Planarizing Interlevel Dielectrics by Chemical–Mechanical Polishing," Solid State Technology, May 1992, pp. 87–91.

Kolenkow et al., "Chemical–Mechanical Wafer Polishing and Planarization in Batch Systems," Solid State Technology, Jun. 1992, pp. 112–114.

Jairath, et al., "Chemical–Mechanical Polishing: Process manufacturability," Solid State Technology, Jul. 1994, 4 pgs.

Martinez, "Chemical–Mechanical Polishing: Route to global planarization," Solid State Technology, May 1994, 3 pgs.

Iqbal et al., "Chemical–Mechanical Polishing of interlayer dielectric: A review," Solid State Technology, Oct. 1994, 4 pgs.

Heyboer et al., "Chemomechanical Silicon Polishing," Electrochem. Soc. vol. 138, No. 3, Mar. 1991, 2 pgs.

Patrick, et al., "Application of Chemical Mechanical Polishing to the Fabrication of VLSI Circuit Interconnections," Electrochem. Soc. vol. 138, No. 6, Jun. 1991, 7 pgs.

Poon et al., "A Manufacturable Chemical–Mechanical Polish Technology with a Novel Low–Permittivity Stop–layer for Oxide Polishing," Advanced products Research and Development Laboratory, Motorola Inc., 8B–5, pp. 115–116.

* cited by examiner

PRESSURE REGULATOR
93b
98b
92b
96b
90
92a
98a
93a
PRESSURE REGULATOR
93c
98c
92c
PRESSURE REGULATOR
96c
96a
99
COMPUTER
76
70a
74
87
80
78
72
66
94a
94c
94b
100

CARRIER HEAD INCLUDING A FLEXIBLE MEMBRANE AND A COMPLIANT BACKING MEMBER FOR A CHEMICAL MECHANICAL POLISHING APPARATUS

This application is a continuation of U.S. application Ser. No. 09/001,702, filed Dec., 31, 1997. U.S. Pat. No. 6,080, 050.

BACKGROUND

The present invention relates generally to chemical mechanical polishing of substrates, and more particularly to a carrier head for a chemical mechanical polishing apparatus.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad. The polishing slurry tends to be abrasive and corrosive, and can damage the mechanical parts inside the carrier head.

The substrate is typically vacuum-chucked to the underside of the carrier head at certain times during the polishing process, such as when the substrate is to be moved between polishing stations. However, the stress applied to the substrate during the vacuum-chucking procedure, particularly as the substrate is lifted off the polishing pad, may damage the substrate, e.g., the substrate may fracture. Also, it is possible for the substrate to become detached from the carrier head, e.g., when the carrier head is being moved between polishing stations, if the substrate is not properly chucked. If the substrate drops, it may be damaged when it falls.

Accordingly, it would be useful to provide a carrier head capable of reliably lifting the substrate off the polishing pad. It would also be useful if the interior of the carrier head was not exposed to contamination by slurry.

SUMMARY

In one aspect, the invention is directed to a carrier head for a chemical mechanical polishing apparatus. The carrier head comprises a base, a flexible membrane coupled to the base to define an evacuable chamber and provide a substrate receiving surface, and a compliant backing member having a plurality of indentations. The backing member is positioned relative to the flexible membrane such that when the chamber is evacuated, the flexible membrane contacts the backing member.

In another aspect, the carrier head comprises a base, a flexible membrane coupled to the base to define an evacuable chamber, a first surface of the flexible membrane providing a substrate receiving surface, and a backing member having a plurality of indentations formed in a compliant surface thereof. The backing member is positioned between the base and the flexible membrane such that when the chamber is evacuated, a second surface of the flexible membrane contacts the compliant surface of the backing member.

In another aspect, the carrier head comprises a base, a flexible membrane coupled to the base to define an evacuable chamber and provide a substrate receiving surface, and a compliant backing member including an upper sheet and a lower sheet. A peripheral portion of the upper and lower sheets is joined so that the backing member encloses a cavity, and the upper and lower sheets are further joined in a plurality of regions located interior to the peripheral portion to define an array of indentations in the backing member. The backing member is positioned between the base and the flexible membrane such that when the chamber is evacuated, the flexible membrane contacts the backing member.

In another aspect, the carrier comprises a base, a flexible membrane coupled to the base to define an evacuable chamber and provide a substrate receiving surface, and a compliant backing member including an upper sheet and a lower sheet. A peripheral portion and a plurality of interior portions of the upper and lower sheets are joined together to define an array of interconnected cells. The backing member is positioned between the base and the flexible membrane such that when the chamber is evacuated, the flexible membrane contacts the backing member.

Implementations of the invention may include the following. The backing member may enclose a pressurizable cavity. The backing member may include a flexible upper member and a flexible lower member (e.g., bonded silicone rubber sheets), with the upper member joined to the lower member in a plurality of joined regions. The joined regions may define the indentations and the non-joined regions may define the cavity. Apertures may extend through the joined regions. The cells may be substantially annular, and each may surround a joined central region. An aperture may extend through the backing member in the central region of each annular cell. The cells and/or the indentations may be arranged in a hexagonal array. The cells may be air pockets formed between the upper and lower member. The base may include a passage to provide fluid communication to the cavity. A mesh may be positioned in the cavity to prevent the upper and lower members from adhering in the non-joined regions. The cells may be connected by channels between the upper and lower sheets. In another aspect, the invention is directed to an assembly for a chemical mechanical polishing system. The assembly comprises a carrier head, a vacuum source, and a sensor. The carrier head includes a base, a flexible membrane coupled to the base to define a chamber and provide a substrate receiving surface, and a compliant backing member having a plurality of indentations and enclosing a cavity. The vacuum source fluidly connected to the chamber to evacuate the chamber. The sensor measures the pressure in the cavity and generates an output signal indicative of whether the substrate is attached to the substrate receiving surface. The flexible membrane and backing member are configured such that if the chamber is evacuated and a substrate is attached to the substrate receiving surface, the substrate presses against the backing member so that a pressure in the cavity increases to a first pressure which is greater than a second pressure that would result if the substrate were not attached to the substrate receiving surface.

Implementations may include the following. The assembly may further comprise a processor configured to indicate that the substrate is attached to the substrate receiving surface if the pressure in the cavity is greater than a threshold pressure.

In another aspect, the invention is directed to a method of chucking a substrate to a carrier head. The substrate is positioned against a lower surface of a flexible membrane of the carrier head. A compliant backing member which includes a plurality of indentations and which is located adjacent to the flexible membrane of the carrier head is inflated. A chamber defined by the flexible membrane is evacuated to draw the flexible membrane into contact with the backing member.

Implementations may include the following. The substrate may be lifted off a polishing pad.

Advantages of the invention include the following. The carrier head reliably chucks the substrate. In addition, the compliant backing member reduces stress on the substrate and thus reduces the danger of damaging the substrate.

Other advantages and features of the invention will become apparent from the following description, including the drawings and claims.

BRIEF DESCRIPTION OF THE DRAWINGS

Like reference numbers are designated in the various drawings to indicate like elements. A primed reference number indicates that an element has a modified function, operation or structure.

DETAILED DESCRIPTION

Figure 1:
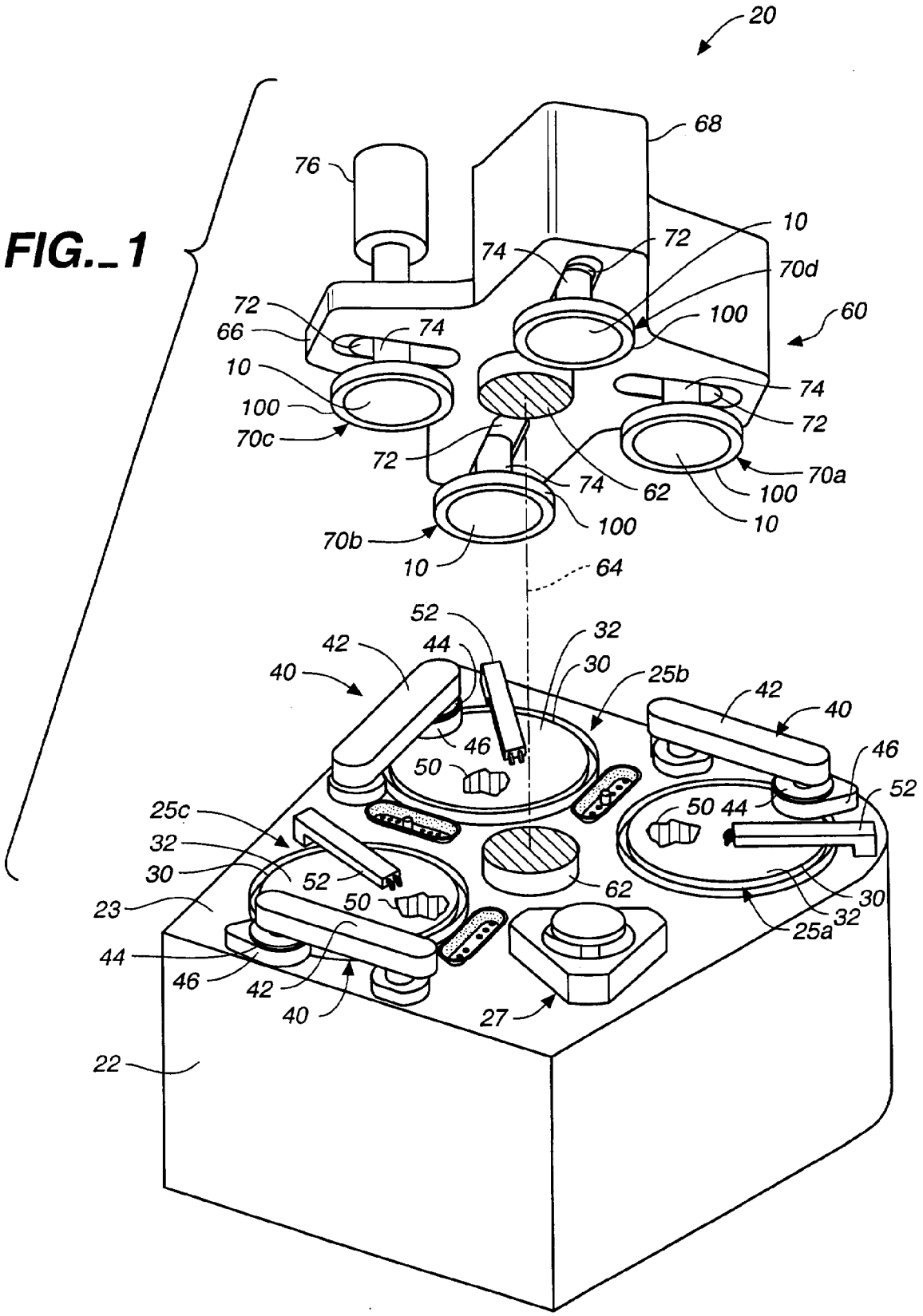
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus 20 may be found in pending U.S. application Ser. No. 08/549,336, by Perlov, et al., filed Oct. 27, 1995, entitled CONTINUOUS PROCESSING SYSTEM FOR CHEMICAL MECHANICAL POLISHING, and assigned to the assignee of the present invention, the entire disclosure of which is hereby incorporated by reference.

The CMP apparatus 20 includes a lower machine base 22 with a table top 23 mounted thereon and a removable upper outer cover (not shown). Table top 23 supports a series of polishing stations 25*a*, 25*b* and 25*c*, and a transfer station 27. Transfer station 27 may form a generally square arrangement with the three polishing stations 25*a*, 25*b* and 25*c*. Transfer station 27 serves multiple functions of receiving individual substrates 10 from a loading apparatus (not shown), washing the substrates, loading the substrates into carrier heads (to be described below), receiving the substrates from the carrier heads, washing the substrates again, and finally transferring the substrates back to the loading apparatus.

Each polishing station 25*a*–25*c* includes a rotatable platen 30 on which is placed a polishing pad 32. If substrate 10 is an eight-inch (200 millimeter) diameter disk, then platen 30 and polishing pad 32 will be about twenty inches in diameter. Platen 30 may be connected by a platen drive shaft (not shown) to a platen drive motor (also not shown).

Each polishing station 25*a*–25*c* may further include an associated pad conditioner apparatus 40. Each pad conditioner apparatus 40 has a rotatable arm 42 holding an independently rotating conditioner head 44 and an associated washing basin 46. The conditioner apparatus maintains the condition of the polishing pad so that it will effectively polish any substrate pressed against it while it is rotating.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against polishing pads of polishing stations 25*a*–25*c*. One of the carrier head systems receives a substrate from and delivers the substrate to transfer station 27. The carousel motor may orbit carrier head systems 70*a*–70*d*, and the substrates attached thereto, about carousel axis 64 between the polishing stations and the transfer station.

Each carrier head system 70*a*–70*d* includes a polishing or carrier head 100. Each carrier head 100 independently rotates about its own axis, and independently laterally oscillates in a radial slot 72 formed in carousel support plate 66 (see also FIG. 2). A carrier drive shaft 74 extends through a drive shaft housing 78 (see FIG. 3) to connect a carrier head rotation motor 76 to carrier head 100 (shown by the removal of one-quarter of cover 68). There is one carrier drive shaft and motor for each head.

Figure 2:
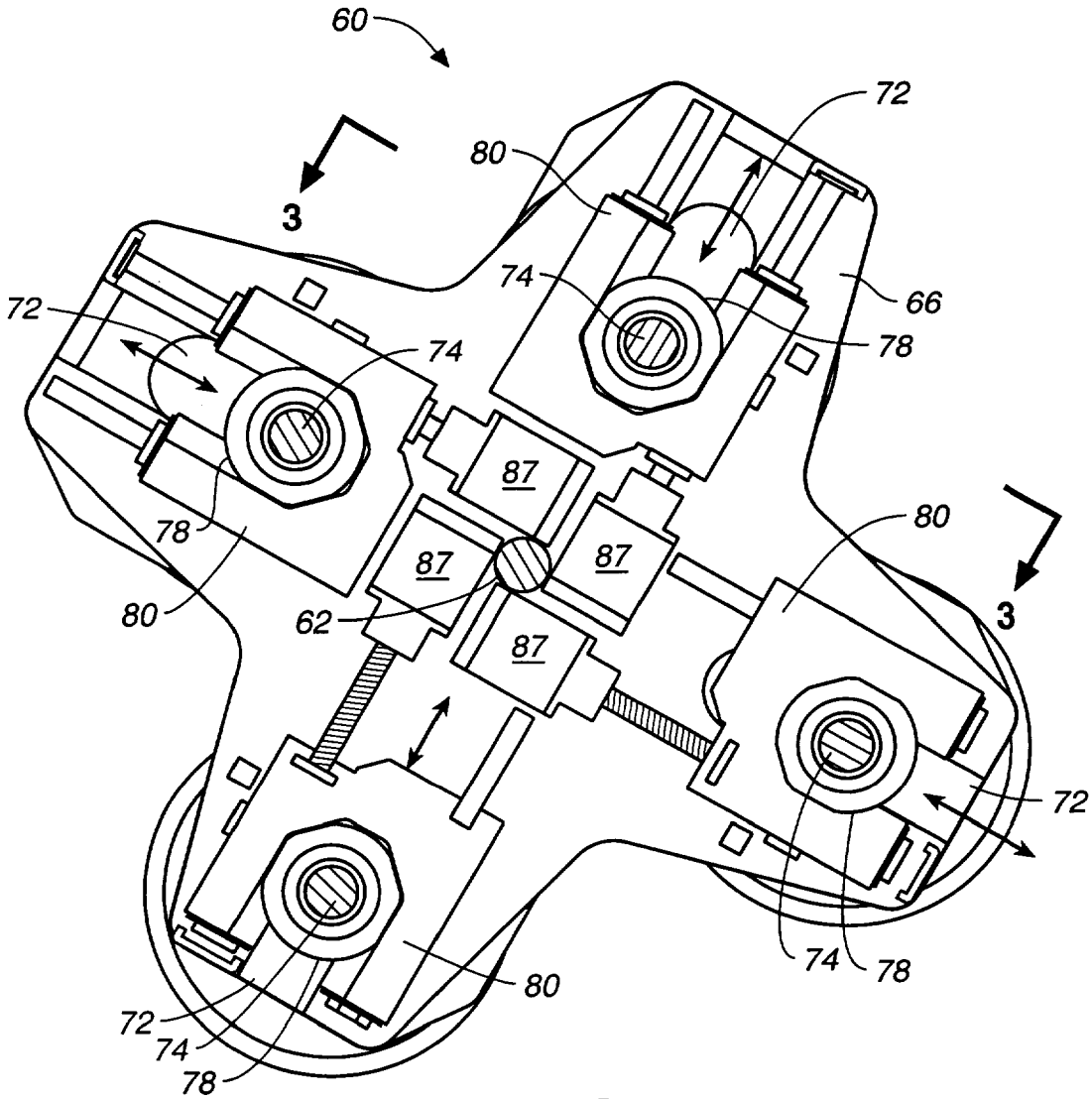
FIG. 2 is a schematic top view of a carousel, with the upper housing removed.

Referring to FIG. 2, in which cover 68 of carousel 60 has been removed. The top of carousel support plate 66 supports four slotted carrier head support slides 80. Each slide 80 is aligned with one of radial slots 72 and may be driven along the slot by a radial oscillator motor 87. The four motors 87 are independently operable to independently move the four slides along radial slots 72 in carousel support plate 66.

Figure 3:
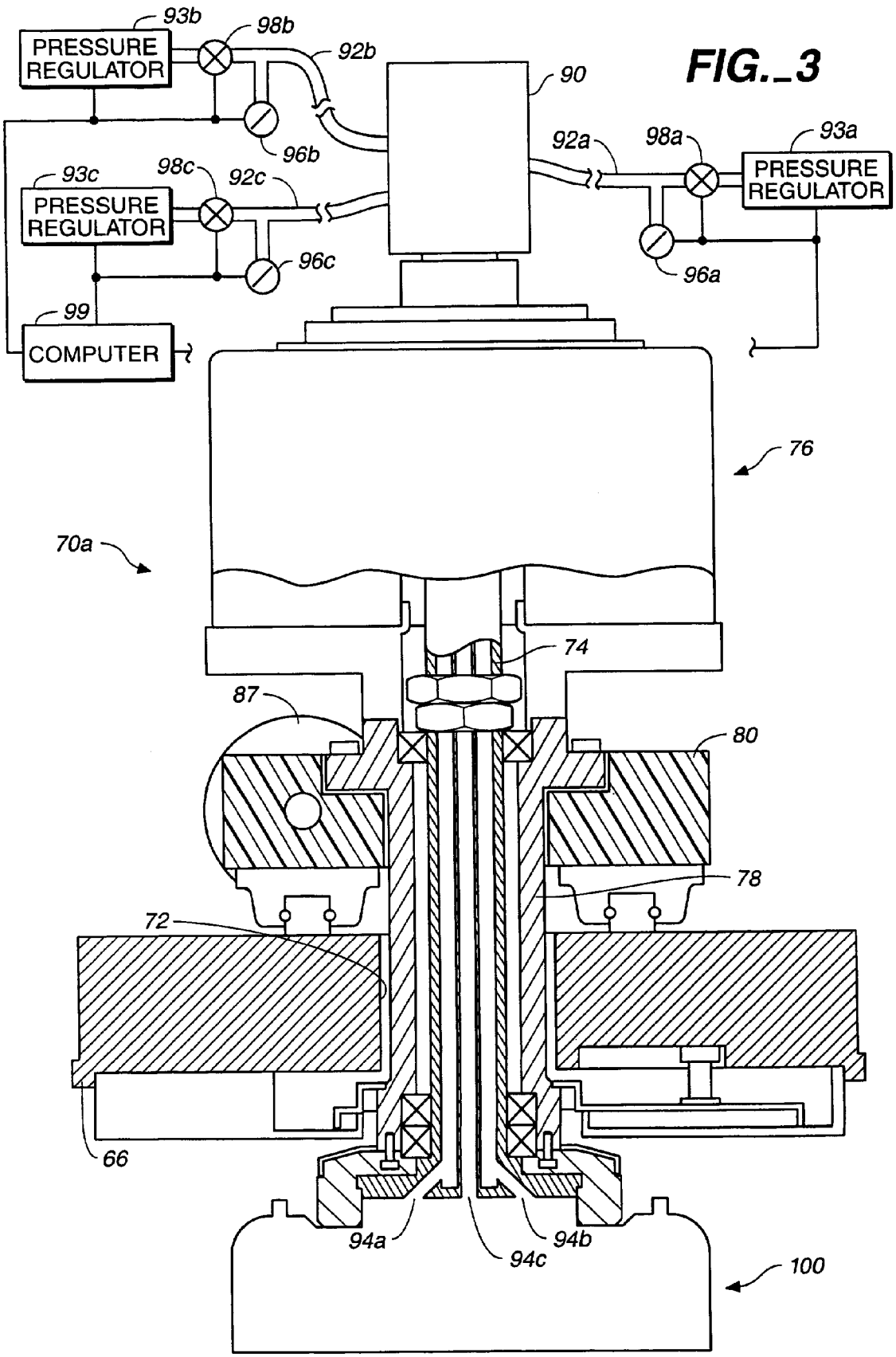
FIG. 3 is partially a cross-sectional view of the carousel of FIG. 2 along line 3—3, and partially a schematic diagram of the pressure regulators used by the chemical mechanical polishing apparatus.

Referring to FIG. 3, a rotary coupling 90 at the top of drive motor 76 couples three or more fluid lines 92*a*, 92*b* and 92*c* to three or more channels 94*a*, 94*b* and 94*c*, respectively, in drive shaft 74. Three vacuum or pressure sources 93*a*, 93*b* and 93*c*, such as pumps, venturis or pressure regulators (hereinafter referred to simply as "pumps"), may be connected to fluid lines 92*a*, 92*b* and 92*c*, respectively. Three pressure sensors or gauges 96*a*, 96*b* and 96*c* may be connected to fluid lines 92*a*, 92*b* and 92*c*, respectively, and control valves 98*a*, 98*b* and 98*c* may be connected across the fluid lines 92*a*, 92*b* and 92*c*, respectively. Pumps 93*a*–93*c*, pressure gauges 96*a*–96*c* and valves 98*a*–98*c* are appropriately connected to a general-purpose digital computer 99. Computer 99 may control the operation of pumps 93*a*–93*c*, as described in more detail below, to pneumatically power carrier head 100.

During actual polishing, three of the carrier heads, e.g., those of carrier head systems 70*a*–70*c*, are positioned at and above respective polishing stations 25*a*–25*c*. Each carrier head 100 lowers a substrate into contact with polishing pad 32. As noted, slurry 50 acts as the media for chemical mechanical polishing of the substrate.

Generally, carrier head 100 holds the substrate in position against the polishing pad and distributes a force across the back surface of the substrate. The carrier head also transfers torque from the drive shaft to the substrate.

Figure 4:
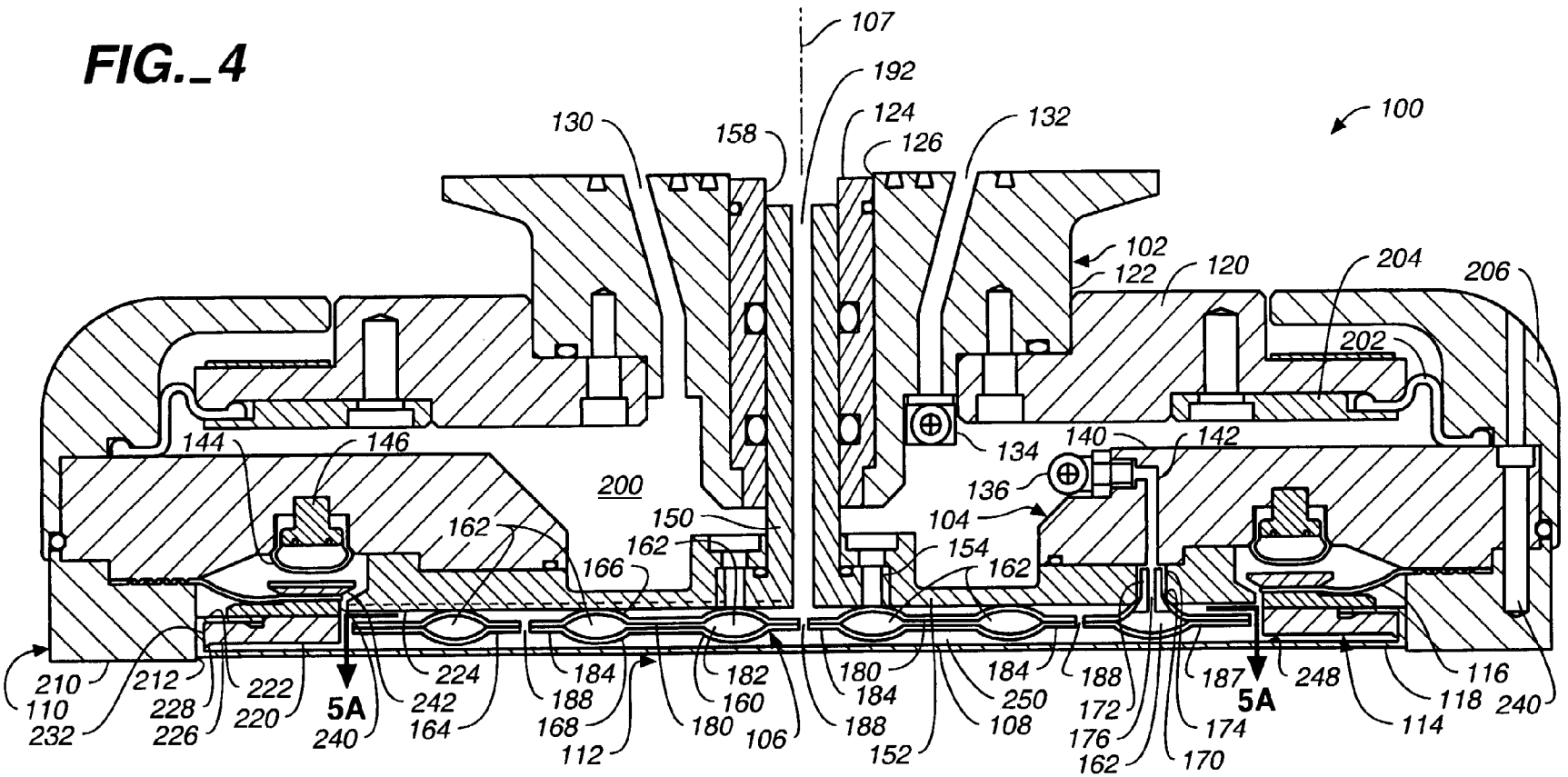
FIG. 4 is a schematic cross-sectional view of a carrier head.

Referring to FIG. 4, carrier head 100 includes a housing 102, a base 104, a flexible member or membrane 118, a compliant backing member 106, and a retaining ring 110. A description of a similar carrier head may be found in pending U.S. application Ser. No. 08/861,260, filed May 21, 1997, entitled A CARRIER HEAD WITH A FLEXIBLE MEMBRANE FOR A CHEMICAL MECHANICAL POLISHING SYSTEM, and assigned to the assignee of the present invention, the entire disclosure of which is hereby incorporated by reference. It is noted that the cross-sectional view of backing member 106 is taken along line A—A of FIG. 5A, although the remainder of the view of the carrier head is taken along a central plane through the carrier head.

The housing 102 can be connected to drive shaft 74 to rotate therewith about an axis of rotation 107 which is substantially perpendicular to the surface of the polishing pad. A loading chamber 200 is located between housing 102 and base 104 to apply a load, i.e., a downward pressure, to base 104. The vertical position of base 104 relative to polishing pad 32 is also controlled by means of loading chamber 200.

The flexible membrane 118 may be connected to base 104 by a support structure 114 and a flexure diaphragm 116. The flexible membrane 118 is attached to support structure 114, and the support structure is suspended beneath base 104 by flexure diaphragm 116. The flexible membrane 118 extends below base 104 to provide a mounting surface 108 for the substrate. As described below, pressurization of a chamber 250 defined by flexible membrane 118 presses the substrate against the polishing pad.

The housing 102 is generally circular in shape to correspond to the circular configuration of a substrate to be polished. The housing includes an annular housing plate 120 and a generally cylindrical housing hub 122. The housing plate 120 may surround and be affixed to housing hub 122. A cylindrical bushing 124 may fit into a vertical bore 126 through the housing hub to connect the housing to the gimbal mechanism.

The base 104 includes a generally ring-shaped body 140 located beneath housing 102. A flexible membrane 144 may be attached to the lower surface of base 104 by a clamp ring 146 to create a compressible bladder. A passage 142 may extend through the base to provide fluid communication with the bladder created by membrane 144.

The base 104 may also include a gimbal rod 150 and a flexure ring 152. The upper end of gimbal rod 150 fits into a passage 158 through cylindrical bushing 124. The lower end of gimbal rod 150 includes an annular flange 154 which is secured to an inner portion of flexure ring 152. The outer portion of flexure ring 152 is secured to body 140. Gimbal rod 150 may slide vertically within passage 158 so that base 104 may move vertically with respect to housing 102. However, gimbal rod 150 prevents any substantial lateral motion of base 104 with respect to housing 102. The flexure ring 152 is sufficiently flexible to permit body 140 to pivot with respect to housing 102 so that it remains substantially parallel to the surface of the polishing pad during polishing.

Retaining ring 110 may be secured at the outer edge of base 104. Retaining ring 110 is a generally annular ring having a bottom surface 210 to contact the polishing pad. The bottom surface 210 may be substantially flat, or it may have grooves or channels to permit slurry to reach the substrate. An inner surface 212 of retaining ring 110 defines, in conjunction with mounting surface 108 of flexible membrane 118, a substrate receiving recess 112. The retaining ring 110 holds the substrate in the substrate-receiving recess and transfers the lateral load from the substrate to the base. When fluid is directed into loading chamber 200 and base 104 is pushed down, retaining ring 110 is also pushed down to apply a load to polishing pad 32.

Alternately, the retaining ring may constructed as described in the concurrently filed application entitled A CARRIER HEAD WITH A REMOVABLE RETAINING RING FOR A CHEMICAL MECHANICAL POLISHING APPARATUS, by Chen et al., Express Mail Receipt No. EM202539938US, assigned to the assignee of the present invention, the entire disclosure of which is hereby incorporated by reference.

The backing member 106 is secured below base 104. The backing member 106 has a corrugated or bumpy lower surface 160. Specifically, the backing member may be formed of a compliant material having an array of bumps and corresponding indents. When flexible membrane 110 is in contact with the lower surface of the backing member, the spaces defined by the indents will provide a plurality of pockets 194 (see FIG. 6) between the flexible membrane and the backing member. The pockets may be used to vacuum chuck the substrate to the carrier head.

Figure 5A:
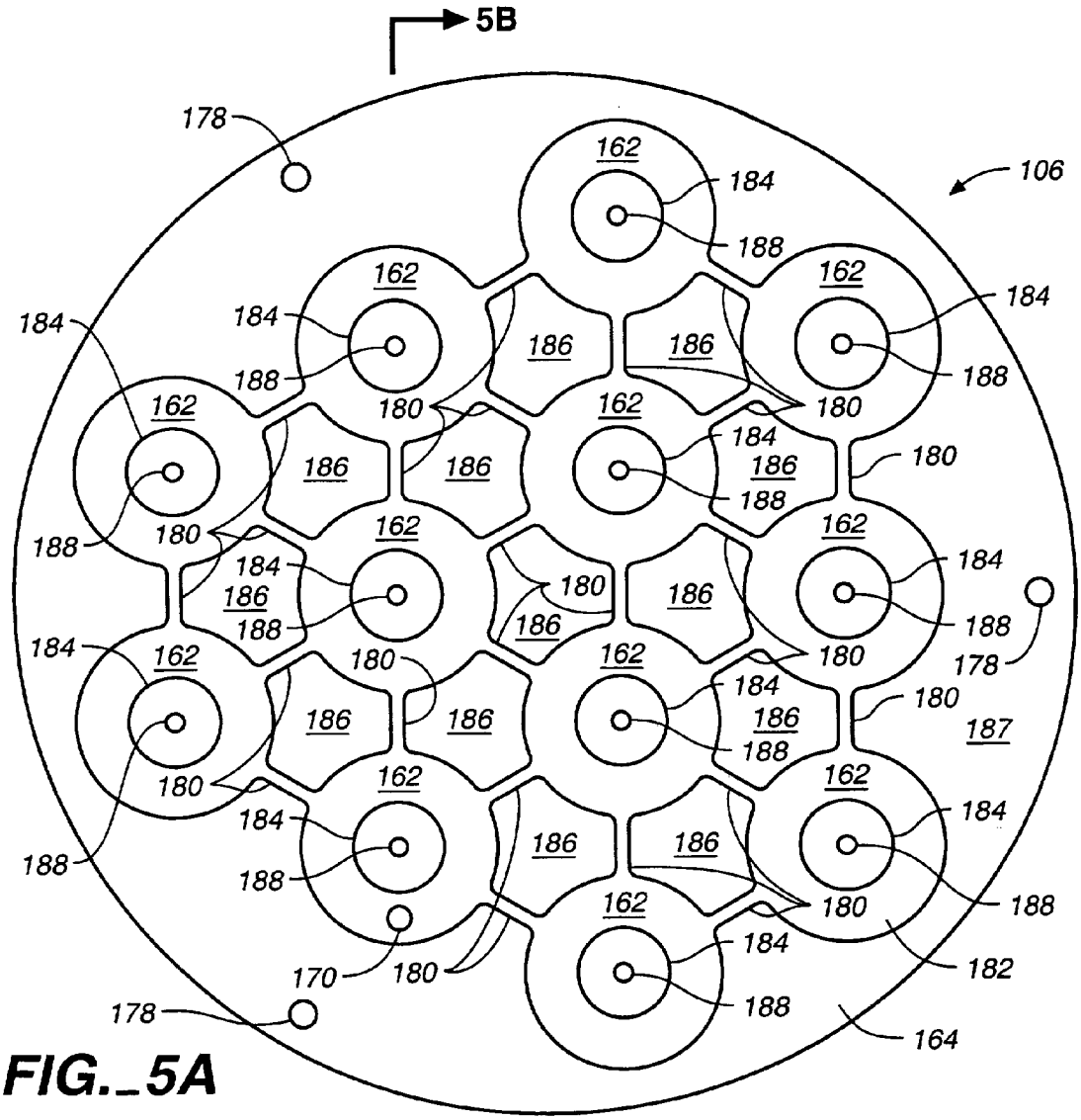
FIG. 5A is a schematic top view of a compliant backing member of the carrier head of FIG. 4 taken along line 5A—5A.
Figure 5B:
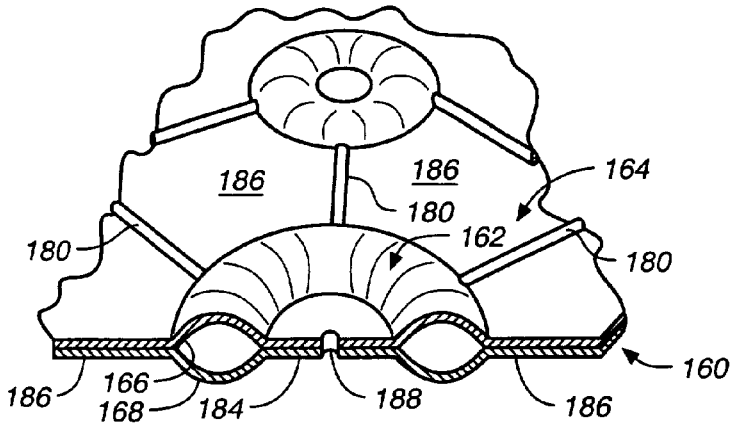
FIG. 5B is an enlarged perspective view, partially in cross-section, of a cell of the compliant backing member of FIG. 5A.

The backing member 106 may include an array of air pockets or inflatable cells 162 connected by interstitial regions 164 (see also FIGS. 5A and 5B). The cells 162 may be fluidly connected by channels 180 to form a single cavity 182 in the backing member. The cells provide the raised regions of the lower surface, whereas the interstitial regions between the cells provide the valleys in the lower surface. The valleys will define the pockets between the flexible membrane and the backing member. Thus, the backing member functions like an air mattress.

Backing member 106 may be formed of an upper flexible sheet 166 and a lower flexible sheet 168. The upper and lower sheets 166 and 168 are bonded together in interstitial regions 164. The gaps between upper and lower sheets 166 and 168 in the unbonded regions provide the cells 162 and channels 180. Both sheets may be formed of silicone rubber having a thickness of about 20 mils and a durometer measurement of about 40 on the Shore A scale. Upper and lower sheets 166 and 168 may be bonded by a vulcanization process. Alternatively, the sheets may be bonded with an adhesive.

To secure backing member 106 to base 104, a plurality of screws or bolts (not shown) may extend through apertures 178 (see FIG. 5A) around the periphery of the backing member and into receiving recesses in the base.

A threaded screw 172 may fit through an aperture 170 in upper sheet 166 (see also FIG. 5A) and into a threaded recess 174 in flexure ring 152. Threaded screw 172 may include a channel 176 through the center thereof to connect one of the cells to a passage 142 through base 104 to provide fluid communication with cavity 182.

Referring to FIGS. 5A and 5B, in one implementation of backing member 106, narrow and shallow channels 180 connect the individual cells 162 to each other to provide a single pressurizable cavity 182. The cells may be arranged in a hexagonal lattice, and may be generally circular or annular in shape. For example, each annular cell 162 surrounds a central bonded region 184, and is separated from cells by bonded regions 186. The gaps between bonded regions 186 provide channels 180. In addition, a peripheral region 187 of the backing member is bonded.

An aperture 188 may be formed in each central bonded region 184 to provide fluid communication between a top surface and a bottom surface of the backing member. The bottom surface of base 104 may be provided with grooves or channels 224 (shown in phantom in FIG. 4) so that fluid can flow through apertures 188 and between base 104 and backing member 106 to fluidly connect chamber 250 with pockets 194 (see FIG. 6). This insures that the pockets formed between flexible membrane 118 and backing member 106 are evacuated when pump 96*c* evacuates chamber 250. Additional apertures could be formed in bonding regions 186.

Figure 5C:
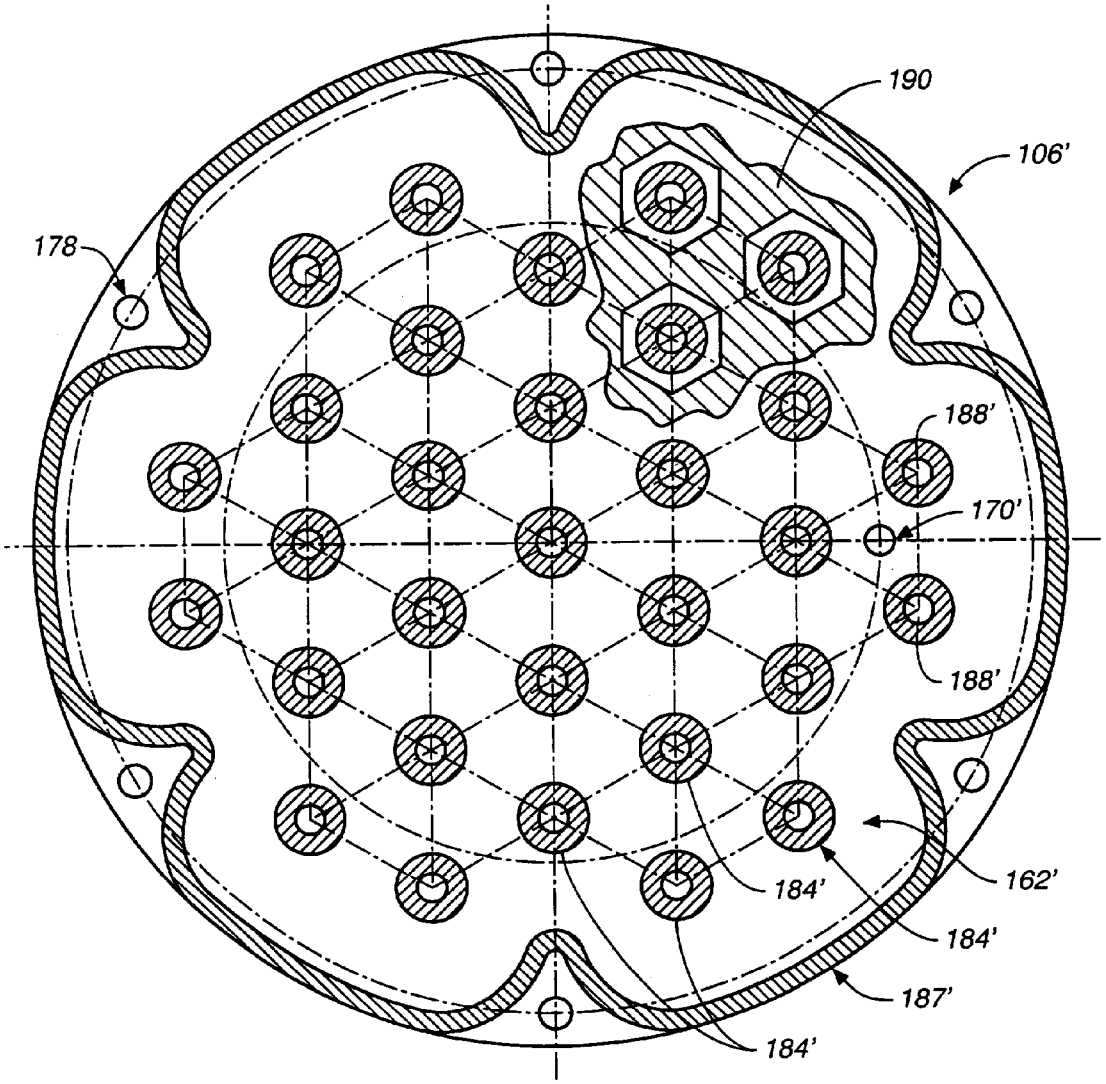
FIG. 5C is a schematic top view of another embodiment of a compliant backing member.

Referring to FIG. 5C, in another implementation, the upper and lower sheets of backing member 106' are bonded at a periphery region 187' to form a single cell 162'. The upper and lower sheets may also be bonded in a plurality of regions 184' inside cell 162'. The bonded regions 184' provide the indents in the lower surface, and may be arranged in a hexagonal array.

The flexible sheets of backing member 106' have a tendency to adhere to each other. This tends to prevent the backing member from inflating. Therefore, backing member 106' may include an anti-stick layer or device disposed between the flexible sheets. For example, a wire mesh 190 may be stamped into a pattern which fits into cell 162'. The wire mesh prevents the sheets from sticking to each other, ensuring full inflation of the backing member. Alternately, the interior surfaces of the upper and lower sheets and may be patterned, e.g., shallow grooves may be formed in the surface of the sheets, to reduce the tendency of the sheets to adhere to each other.

Figure 5D:
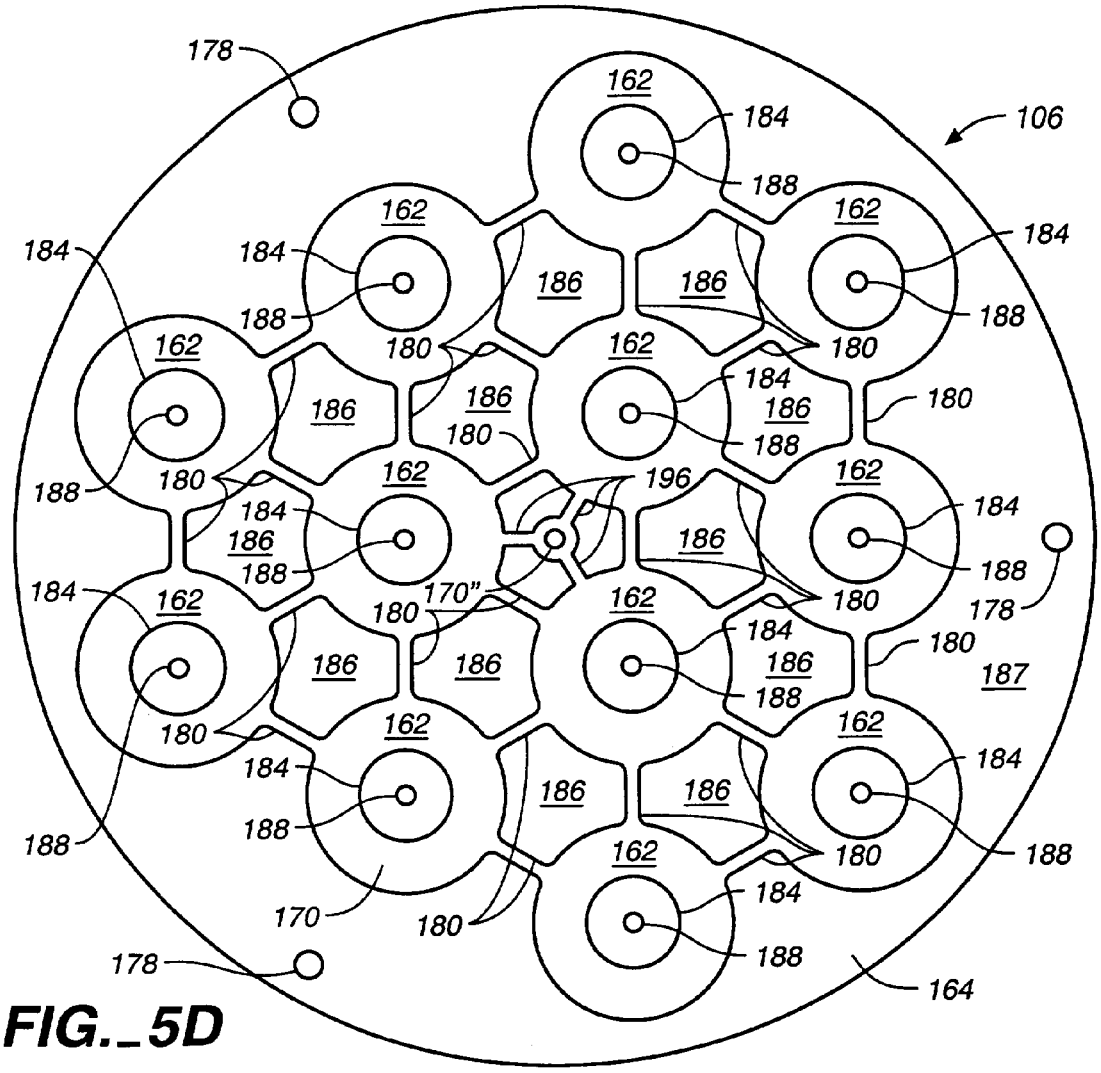
FIG. 5D is a schematic top view of yet another embodiment of a compliant backing member.

Referring to FIG. 5D, in another embodiment, aperture 170" may be positioned in the center of upper sheet 166" so that cavity 182" is connected to passage 192 in gimbal rod 150 rather than to passage 142 in body 140. In this embodiment, the functions of pumps 93*b* and 93*c* are switched. The aperture 170" is connected to the surrounding cells by radial passages 196.

Returning to FIGS. 3 and 4, the pump 93*b* may be connected to cavity 182 via fluid line 92*b*, rotary coupling 90, channel 94*b* in drive shaft 74, passage 132 in housing 102, a flexible tube (not shown), passage 142 in base 104, and channel 176 through threaded screw 172. Two fixtures 134 and 136 may provide attachment points to connect the flexible tube between housing 102 and base 104. If pump 93*b* directs a fluid, e.g., a gas, such as air, into cavity 182, the backing member will be inflated and will expand. On the other hand, if pump 93*b* evacuates cavity 182, the backing member will contract. As discussed below, backing member 106 may be used to provide a compliant surface for flexible membrane 118 to rest against.

Loading chamber 200 is formed by providing a seal between base 104 and housing 102. The seal is provided by a rolling diaphragm 202, an inner clamp ring 204, and an outer clamp ring 206. Rolling diaphragm 202, which may be formed of a sixty mil thick silicone sheet, is generally ring-shaped, with a flat middle section and protruding edges. Inner clamp ring 204 is arranged to clamp the inner edge of rolling diaphragm 202 against housing 102. Outer clamp ring 206 is arranged to clamp the outer edge of rolling diaphragm 202 to base 104. Thus, the space between housing 102 and base 104 is sealed to form loading chamber 200.

The pump 93*a* may be connected to loading chamber 200 via fluid line 92*a*, rotary coupling 90, channel 94*a* in drive shaft 74, and passage 130 in housing 102. Fluid, e.g., a gas, such as air, is pumped into and out of loading chamber 200 to control the load applied to base 104. If pump 93*a* directs fluid into loading chamber 200, the chamber volume will increase as base 104 is pushed down. On the other hand, if pump 93*a* pumps evacuates fluid from loading chamber 200, the chamber volume will decrease as base 104 is drawn up.

Support structure 114, flexure diaphragm 116 and flexible membrane 118 are suspended below base 104. The flexible membrane 118 extends beneath support structure 114 so that the upper surface of the flexible membrane can contact the lower surface of compliant backing member 106.

Support structure 114 includes a support ring 220, an annular lower clamp 240, and an annular upper clamp 242. The support ring 220 is positioned around the compliant backing member so that when chamber 250 is evacuated, the lower surface of the support ring is generally co-planar with the lower surface of the compliant backing member. Flexure diaphragm 116 may be a generally planar annular ring, the outer edge of which is clamped between lower clamp 240 and upper clamp 242. The flexure diaphragm 116 is flexible and elastic, although it could be rigid in the radial and tangential directions.

Flexible membrane 118 may be a generally circular sheet formed of a flexible and elastic material, such as chloroprene or ethylene propylene rubber. A portion of flexible membrane 118 extends around a lower corner of support ring 220, upwardly around an outer cylindrical surface 232 of the support plate, and inwardly along upper surface 222 of the support plate. The flexible membrane 118 is clamped between lower clamp 240 and support ring 220.

During polishing, substrate 10 is positioned in substrate receiving recess 112 with the backside of the substrate positioned against mounting surface 108. A raised lip 228 on a bottom surface 226 of support ring 220 may press against the edge of the substrate through flexible membrane 118.

The space between flexible membrane 118, support structure 114, flexure diaphragm 116, and base 104 defines chamber 250. Pump 93*c* (see FIG. 3) may be connected to chamber 250 via fluid line 92*c*, rotary coupling 90, channel 94*c* in drive shaft 74, and a passage 192 through gimbal rod 150. If pump 93*c* directs a fluid, e.g., a gas, such as air, into chamber 250, then the chamber volume will increase as flexible membrane 118 and support ring 220 are forced down. On the other hand, if pump 93*c* evacuates chamber 250, then the chamber volume will decrease as the membrane and the support ring are drawn up.

Figure 6:
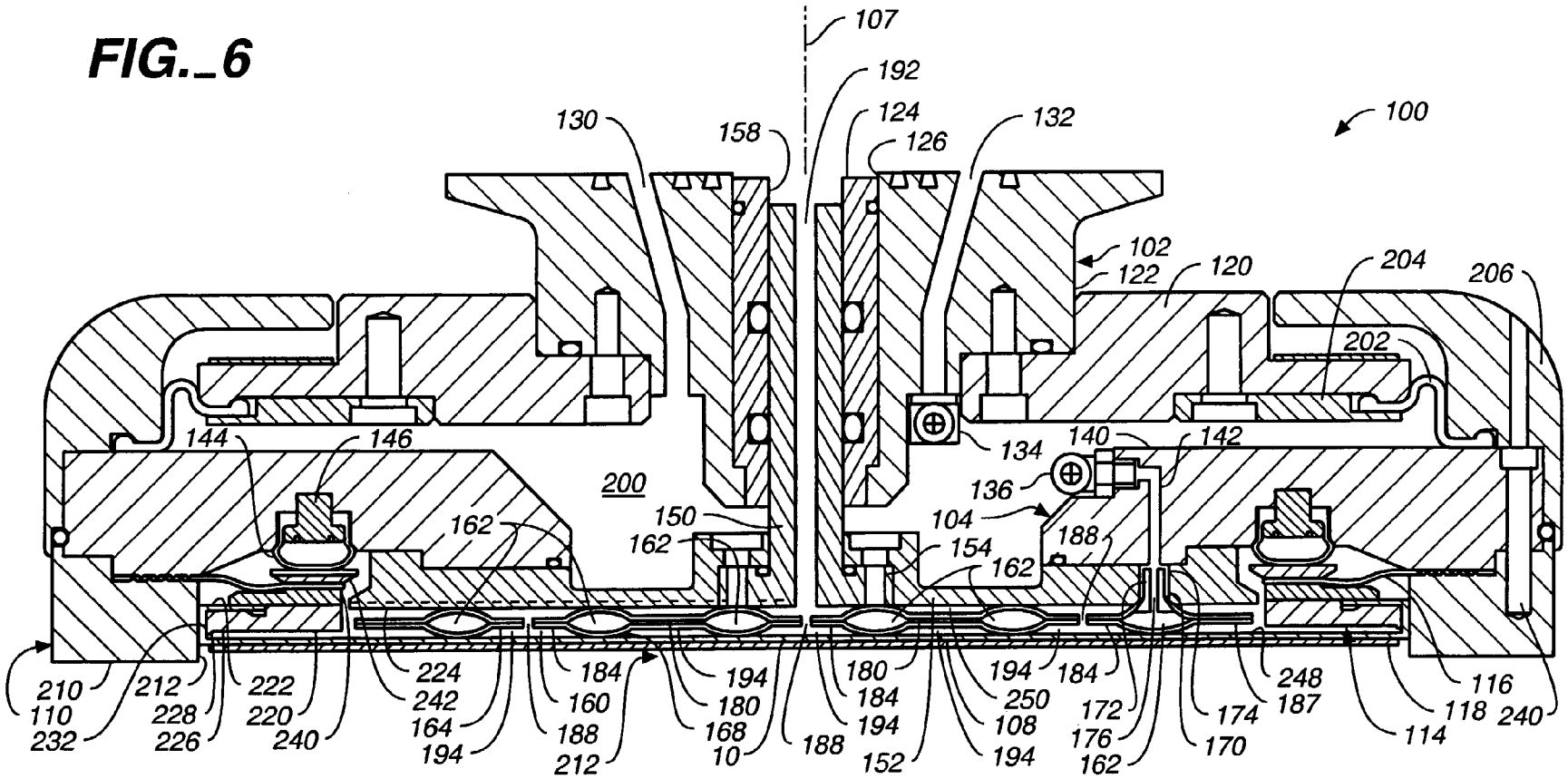
FIG. 6 is a view of the carrier head of FIG. 4 showing a substrate positioned against the lower surface of the flexible membrane of the carrier head.

Referring to FIG. 6, a CMP apparatus utilizing carrier head 100 may operate as follows. Substrate 10 is loaded into substrate receiving recess 112 with the back side of the substrate abutting mounting surface 108 of flexible membrane 118. Fluid is directed into cavity 182 to cause backing member 106 to expand until lower surface 160 contacts an upper surface 248 of flexible membrane 118. Then chamber 250 is evacuated to vacuum chuck the substrate to the mounting surface. If the back side of the substrate is properly positioned against mounting surface 108, the flexible membrane should adhere to the substrate. Thus, the space defined by the indents in compliant member 106 will provide a plurality of low-pressure pockets 194 between the flexible membrane and the backing member. The low-pressure pockets 194 assist in holding the substrate against the mounting surface. The apertures 188 in backing member 106 and the grooves or channels in the bottom surface of base 104 provide fluid communication between pockets 194 so that they are all evacuated. The compliant material of the backing member can deform to provide a superior seal with the flexible membrane. In addition, the plurality of indents in the backing member provide more reliable vacuum-chucking of the substrate. Furthermore, since the backing member can deform (both locally in the cell regions and across its entire lower surface) to follow the contours of the back-side of the substrate, less stress is applied to the substrate during the vacuum-chucking procedure, and the danger of damaging the substrate is reduced.

Finally, fluid is evacuated from chamber 200 to lift base 104, flexible membrane 118 and substrate 10 off of a polishing pad or out of the transfer station. Carousel 60 then, for example, rotates the carrier head to a polishing station. Then fluid is directed into chamber 200 to lower substrate 10 onto the polishing pad, and the pressure in chamber 250 is increased to apply a downward load to the substrate for the polishing step. Cavity 182 may be evacuated so that backing member 106 does not apply a downward pressure to the flexible membrane during polishing.

Figure 8:
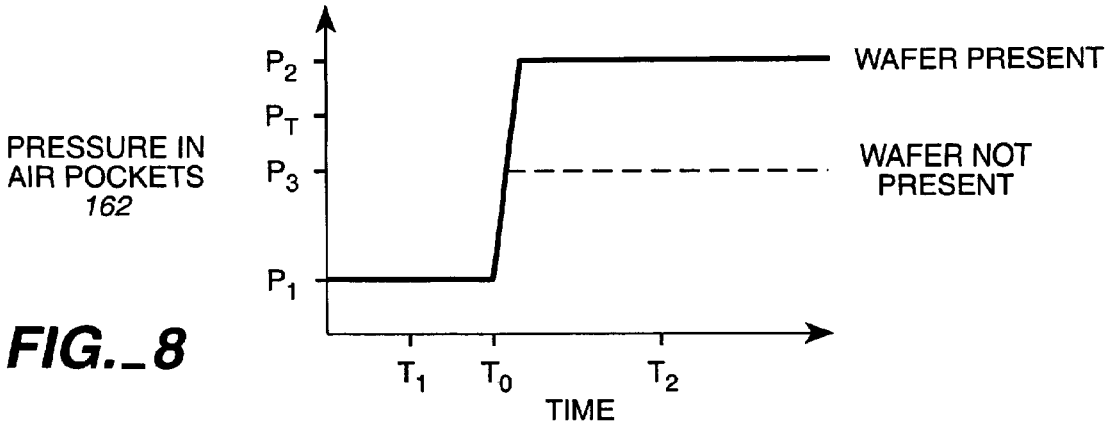
FIG. 8 is a graph showing pressure as a function of time in a CMP apparatus using the carrier head of FIG. 4.
Figure 7:
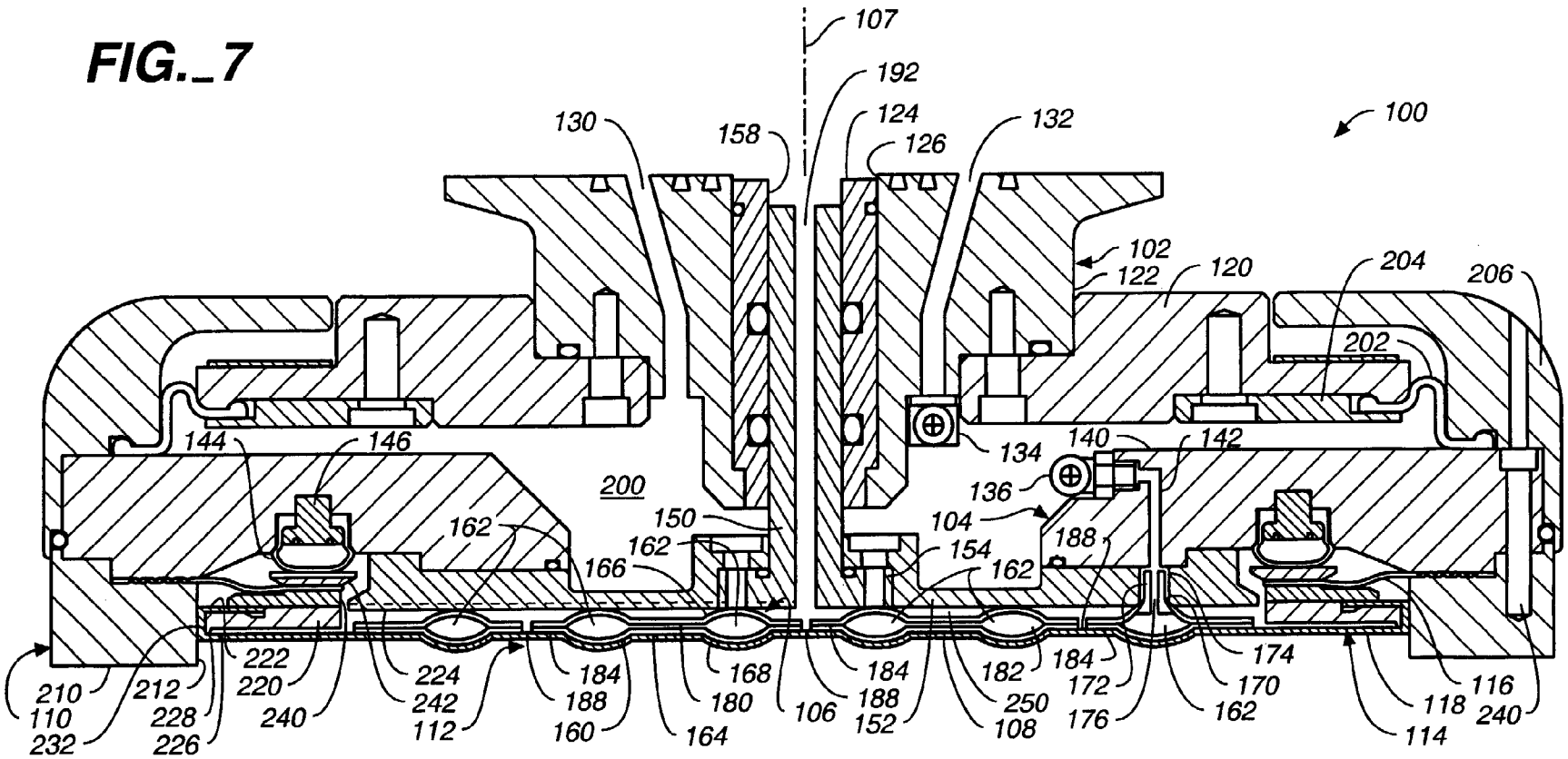
FIG. 7 is a view of the carrier head of FIG. 4 without an attached substrate.

The CMP apparatus may also detect whether a substrate is properly attached to carrier head 100. After backing member 106 is inflated, valve 92*b* is closed to seal cavity 182, and pressure gauge 96*b* is used to monitor the pressure in cavity 182. Referring to FIG. 8, cavity 182 is initially at a pressure $P_1$. If the substrate is properly attached to the carrier head, then the evacuation of chamber 250 will cause the substrate to press upwardly on backing member 106 and compress cells 162 (see FIG. 6). This will reduce the volume of the cells and thereby increase the pressure in the cavity to a pressure $P_2$. On the other hand, if the substrate is not present or is not properly attached to the carrier head, flexible membrane 118 will be pulled into the indentations in lower surface 160 of backing member 106 (see FIG. 7). Although flexible membrane 118 will apply an upward pressure to backing member 106, this pressure will not be as large as the pressure that is applied if a substrate is present. Consequently, the pressure in cavity 182 will rise to a pressure $P_3$ which is less than pressure $P_2$.

The exact values of pressures $P_1$, $P_2$ and $P_3$ depend upon the efficiency of pumps 93*b* and 93*c* and the configuration of the flexible membrane, backing member and base, and may be experimentally determined. Computer 99 may be programmed to compare the pressure measured by pressure gauge 96*b* to an experimentally determined threshold pressure $P_T$ which is between pressures $P_1$ and $P_2$. If the pressure measured by gauge 96*b* is above the threshold pressure $P_T$, then it is assumed that the substrate was successfully chucked to the carrier head.

The present invention has been described in terms of a number of preferred embodiments. The invention, however, is not limited to the embodiments depicted and described. Rather, the scope of the invention is as defined by the appended claims.

What is claimed is:

1. A carrier head for a chemical mechanical polishing apparatus, comprising:

a base;

a flexible membrane coupled to the base to define an evacuable chamber, a first surface of the flexible membrane providing a substrate receiving surface; and a backing member having a plurality of apertures formed in a compliant surface thereof, the backing member positioned relative to the flexible membrane such that when the chamber is evacuated, a second surface of the flexible membrane contacts the compliant surface of the backing member.

2. The carrier head of claim 1 wherein the backing member encloses a pressurizable cavity.

3. The carrier head of claim 2 wherein the pressurizable cavity includes a plurality of interconnected cells.

4. The carrier head of claim 3 wherein the cells comprise air pockets formed between flexible upper and lower sheets.

5. The carrier head of claim 4 wherein the air pockets are connected by channels formed between the upper and lower sheets.

6. A carrier head for a chemical mechanical polishing apparatus, comprising:

a base;

a flexible membrane coupled to the base to define an evacuable chamber, a first surface of the flexible membrane providing a substrate receiving surface; and a backing member having a plurality of indentations formed in a compliant surface thereof, the backing member positioned between the base and the flexible membrane.

7. A method of chemical mechanical polishing a substrate, comprising:

placing a first face of a substrate with a first surface of a flexible membrane that is coupled to a base of a carrier head to define an evacuable chamber;

contacting a second face of the substrate with a polishing surface;

creating relative motion between the substrate and polishing surface; and evacuating the chamber so that a second surface of the flexible membrane is drawn into contact with a compliant surface of a backing member in the carrier head.

8. The method of claim 7 further comprising pressurizing a cavity enclosed by the backing member.

9. The method of claim 8 wherein the cavity includes a plurality of interconnected cells.

10. The method of claim 9 wherein the cells comprise air pockets formed between flexible upper and lower sheets.

11. The method of claim 10 wherein the air pockets are connected by channels formed between the upper and lower sheets.

12. A carrier head for a chemical mechanical polishing apparatus, comprising:

a base;

a backing member having a compliant surface with a plurality of indentations;

a flexible membrane coupled to the base to define a chamber and having a first surface that is adjacent a substrate during polishing and a second surface opposite the first surface, a portion of the flexible membrane movable relative to the backing member such that when the chamber is pressurized the second surface of the flexible membrane is spaced apart from the compliant surface of the backing member, and when the chamber is evacuated the second surface of the flexible membrane contacts the compliant surface of the backing member.

* * * * *